US005614790A

United States Patent [19]

Fleck, Sr. et al.

[11] Patent Number: 5,614,790

[45] Date of Patent: Mar. 25, 1997

[54] AUTOMATIC ALARM FOR FLUORESCENT BLINKING

[75] Inventors: Charles J. Fleck, Sr., National Park; Robert A. Bohinski, Mount Laurel, both of N.J.

[73] Assignee: The United States of America as represented by the Secretary of the Navy, Washington, D.C.

[21] Appl. No.: 489,264

[22] Filed: Jun. 9, 1995

[51] Int. Cl.[6] ..... H05B 37/02

[52] U.S. Cl. ..... 315/135; 315/105

[58] Field of Search ..... 315/129, 135, 315/105

[56] References Cited

U.S. PATENT DOCUMENTS

| | | | |
|---|---|---|---|
| 2,293,897 | 8/1942 | Gref | 315/129 |
| 3,927,345 | 12/1975 | Licata et al. | 315/DIG. 5 |
| 4,096,413 | 6/1978 | Alley | 315/276 |
| 4,121,079 | 10/1978 | Harmon | 219/10.55 B |
| 4,318,031 | 3/1982 | Lonseth et al. | 315/135 |
| 4,769,579 | 9/1988 | Jou | 315/201 |
| 5,138,235 | 8/1992 | Sun et al. | 315/209 R |
| 5,144,205 | 9/1992 | Motto et al. | 315/244 |
| 5,155,413 | 10/1992 | Bozzer et al. | 315/169.1 |
| 5,184,117 | 2/1993 | Gauthier | 340/784 |
| 5,252,891 | 10/1993 | Huang | 315/86 |

OTHER PUBLICATIONS

"Interfering Fluorescents," Popular Science, Sep. 1994, p. 50.

"Mischievous Fluorescents," Popular Science, 1995.

Davidson, G.E., "Flicker in Lighting Systems (Effect of Sudden Voltage Dips Studied)," Ontario Hydro Research News, Oct. 1952, vol. 4, No. 4, pp. 9–11.

Brieger, Lawrence, "Effect of Voltage Dip Duration on Cyclic Light Flicker,"Electrical Engineering, vol. 70, No. 8, Aug. 1951, pp. 685–689.

Fox, Clifton S., "Lamps, Luminous Tubes, and Other Noncoherent Electric Radiation Sources," Fink and Christiansen, Electric Engineers' Handbook, 2nd Ed., McGraw–Hill, New York, 1982, pp. 11–4 to 11–11.

Markus, John, Modern Electronic Circuits Reference Manual, McGraw–Hill, New York, 1980, ch. 44, pp. 489–494.

Fink, Donald G., Beaty, H. Wayne, Standard Handbook for Electrical Engineers, Twelfth Ed., McGraw–Hill, New York, 1987, pp. 26–17 to 26–23; pp. 26–70 to 26–71.

Susskind, Charles, The Encyclopedia of Electronics, Reinhold Publishing Corp., New York, 1962, pp. 313–315.

Eastman, Arthur A. and Campbell, John H., "Stroboscopic and Flicker Effects from Fluorescent Lamps," Illuminating Engineering, Jan. 1952, pp. 27–35.

Faucett, M.A. and Keener, C.A., "Effects of Harmonics on Watthour Meter Accuracy," Electrical World, 27 Oct. 1945, pp. 82–84.

*Primary Examiner*—Robert Pascal
*Assistant Examiner*—Michael Shingleton
*Attorney, Agent, or Firm*—Howard Kaiser

[57] ABSTRACT

Alarming mechanism, sounding and/or flashing, which signals fluorescent lamp malfunctioning as visibly manifested by flickering. The alarming mechanism according to this invention electrically engages the starter mechanism of a fluorescent lamp and is responsive to current change associated with abnormal flickering. Timely corrective action which is prompted by the alarm may avoid or mitigate one or more deleterious effects of such malfunctioning, such as energy waste, lamp damage, fire hazard and electronic interference. For many embodiments the alarming mechanism and the starter mechanism are advantageously coupled as a single structural unit.

13 Claims, 3 Drawing Sheets

AUTOMATIC ALARM FOR FLUORESCENT BLINKING

The invention described herein may be manufactured and used by or for the Government of the United States of America for governmental purposes without the payment of any royalties thereon or therefor.

BACKGROUND OF THE INVENTION

The present invention relates to illuminative apparatus, more particularly to illuminative apparatus of the type wherein starting means is employed for preheating the electrodes of a fluorescent lamp.

Conventional fluorescent lamps are electric discharge lamps in which gas ionizes and produces radiation which activates fluorescent material inside glass tubing. Generally, a fluorescent lamp includes a phosphor-coated tubular bulb which has electrodes sealed into each end and which contains mercury vapor at low pressure along with an inert starting gas (e.g., argon or an argon-neon mixture). The tubular bulb has been practiced in a variety of shapes but is usually of straight, U-shaped or circular configuration. When the proper voltage is applied across the ends of the tubular bulb, an arc is produced by current flowing between the electrodes through the fill gas. The ultraviolet energy from the arc excites the phosphor coating to emit light; i.e., the phosphor coating transforms some of the ultraviolet energy generated by the electric discharge into light.

The visual sensation of abrupt change in the illumination intensity or brightness of a stationary object is known as "flicker." "Cyclic flicker" is normally inherent in lighting systems which are supplied with alternating current (ac). The light which is emitted from a fluorescent lamp or an incandescent lamp which is operated on ac circuitry typically executes these cyclic pulsations. The cyclic flicker associated with fluorescent lamps is generally of considerably greater magnitude than the cyclic flicker associated with incandescent lamps. Nevertheless, in normal usage the cyclic flicker associated with either fluorescent lamps or incandescent lamps is generally not readily visible.

Sometimes a fluorescent lamp commences another kind of flicker when it is in a malfunctioning mode, often toward the end of its useful life. This abnormal flicker is referred to herein as "blinking." Blinking, as distinguished from cyclic flicker, is an aberrant phenomenon and frequently is visibly appreciable. Blinking generally results from voltage fluctuations caused by sudden variations in load, and may be regular or irregular. Sometimes blinking regularly recurs in accordance with a regular succession of voltage dips; such regular recurrence may be rapid. Other times blinking recurs irregularly, in terms of frequency of occurrence and/or duration, in accordance with corresponding irregularity of voltage dips.

Blinking not only is energy-inefficient but also forewarns a possible fire hazard. The inordinate heating, by excessive voltage, of a component of the fluorescent lamp circuitry represents a potentially combustible situation. Moreover, fluorescent lighting has been known to interfere with proper functioning of digital computers, televisions, radios, remote control devices and other forms of electronic apparatus. See, e.g., "Interfering Fluorescents," *Popular Science,* September 1994, page 50. Electronic equipment has been observed to be especially vulnerable to such interference when the infrared signal emissions from a fluorescent lamp are erratic due to voltage fluctuations associated with blinking of the lamp. Although circuit-breaking capability has been known to be utilized in connection with fluorescent illumination, in conventional practice the actual breaking of the circuit may not be effectuated in timely enough fashion to have avoided significant deleterious effects of malfunctioning associated with blinking.

A blinking light may be inconspicuously located. Even when a blinking light is noticeable, its impact upon an observer can vary. The degrees of perceptibility and objectionability of observed fluorescent blinking correspond to the change in light output in terms of frequency and magnitude, and are affected by several factors such as lamp size, lamp type, illumination level, voltage dip rate of change, voltage dip duration, surrounding brightness and the observer's physiology/psychology. See, e.g., Davidson, G. E., "Flicker in Lighting Systems (Effect of Sudden Voltage Dips Studied)," *Ontario Hydro Research News,* October 1952, vol. 4, no. 4, pages 9–11.

Human nature is such that one may need to be externally motivated in order to act in a responsible manner with regard to some occurrence or state of affairs in one's life. When a blinking fluorescent bulb is noticed, it may not, in and of itself, be annoying or bothersome enough to motivate someone to replace the bulb or otherwise correct the underlying problem, or even to simply terminate operation of the bulb. A person may be particularly neglectful when there remain properly functioning fluorescent bulbs which that person views as sufficiently compensating for the light deficiency or as sufficiently alleviating the disturbance.

SUMMARY OF THE INVENTION

In view of the foregoing, it is an object of the present invention to provide automatically responsive warning apparatus for alerting people to, or heightening people's awareness of, fluorescent lamp malfunctioning which is manifested by blinking.

Another object of this invention is to provide such apparatus which immediately warns of such malfunctioning and thereby affords the opportunity for remedial action which may avoid or ameliorate one or more deleterious consequences of such malfunctioning, such deleterious consequences including energy waste, lamp damage, fire hazard and electronic interference.

Another object of this invention is to provide such apparatus which immediately warns of malfunctioning and thereby affords, significantly prior to automatic ceasing of operation of a fluorescent lamp which has circuit-breaking capability associated therewith, such opportunity for remedial action.

Another object of the present invention is to provide such apparatus which may be manufactured, installed and implemented in a previously manufactured conventional flourescent lamp.

A further object of this invention is to provide such apparatus which may be manufactured and implemented as part of a conventional flourescent lamp.

A further object of the present invention is to provide such apparatus which is economical and efficient and lends itself to widespread use in association with fluorescent illumination.

A fluorescent lamp is generally operated on ac in series with a choke or ballast which serves to limit current to the electrodes of the bulb. One practiced approach to igniting the lamp is to employ a sufficiently high voltage whereby the lamp immediately strikes. According to more common practice, however, the ignition of the lamp is furthered by thermal emission caused by preheating of the electrodes to an appropriate temperature. A starter is generally employed for purposes of carrying out this preheating. The starter usually includes a glow switch which includes an electron tube containing two strips, at least one of which is bimetal, which are closed when heated by the glow discharge.

In normal operation of a typical glow starter, upon application of the transformer voltage a glow discharge commences between the poles of the starter whereby a heating effect warms the bimetal and causes it to bend over into contact with the other pole. This pole-to-pole contact causes a "short circuit" current through the ballast which heats up the electrodes. This short circuit in the starter causes the glow discharge to cease and, consequently, the bimetal to cool down and break contact. Due to the sudden interruption of the short circuit current, a voltage surge is produced by the ballast and applied over the discharge path in the lamp, causing the lamp to ignite; if the lamp does not ignite, the cycle is repeated as many times as necessary to bring about ignition of the lamp.

An easily ionized inert gas is present in the bulb, in addition to mercury, to facilitate starting. The ballast serves as a current-limiting starting resistor which is used, along with the starter, for igniting the arc in the bulb. For ignition to take place, an arc is first struck between the electrode of the starter and the adjacent electrode of the bulb. The resultant heating and additional ionization from this arc permit the main arc to form between the electrodes of the bulb.

Normally, upon ignition a voltage is maintained across the lamp which is approximately half the open voltage and is insufficient to activate the starter. When blinking occurs, this is an indication that the starter cycle is abnormally being repeatedly initiated. Time and again, the lamp is momentarily lit and immediately unlit due to some malfunction. Each time the lamp is de-ignited, the starter is reactivated.

This repetition of starter actuation accompanied by lamp ignition can bring about "flickering overload," which carries and forewarns possible undesirable consequences. The excessive ac current which is produced by the flickering overload generates excessive heat which can eventually damage the circuitry or lead to fire; in particular, the ballast is susceptible to shorting out or melting when extremely heated due to abnormally long duty cycle. Furthermore, energy is wasted and the potential for radio frequency interference is heightened.

The present invention features alarm means which is responsive to current change associated with fluorescent blinking and which automatically signals upon the occurrence of the fluorescent blinking. Depending upon the embodiment, the alarm includes either or both of an auditory alarm (e.g., sounds a beeper) and a visual alarm (e.g., flashes a light).

In accordance with the present invention, the alarm means which electrically engages the starter means may be either structurally separate from the starter means or structurally coupled with the starter means. Thus, for some embodiments of the present invention the alarm means is preferably embodied as a physically separate mechanism which is made to electrically engage the starter mechanism which is found in a conventional, commercially manufactured preheat-starting fluorescent lamp. For most embodiments of this invention, however, the alarm means preferably is physically coupled with the starter means and thus made an integral part of a multi-functional, uni-structural mechanism which is designed to substitute for the starter unit which is found in a conventional, commercially manufactured preheat-starting fluorescent lamp.

According to the present invention, physical coupling of the alarm means and the starter means can be accomplished by any of various approaches. For some such embodiments the alarm mechanism is preferably made to structurally unite with the starter unit which is found in the commercially manufactured fluorescent lamp; hence, the original starter unit is retained, adapted and supplemented. For other such embodiments the multi-functional starter mechanism which comprises starter means and alarm means is preferably manufactured as a unit which entirely replaces the original starter unit; hence, the original starter unit may be discarded. For yet other such embodiments an entire fluorescent lamp unit is preferably manufactured whereby the multi-functional starter mechanism which comprises starter means and alarm means constitutes a subunit which is "built into" the fluorescent lamp unit.

The conventional commercially made starter mechanism is uni-functional or bi-functional. Some conventional starter mechanisms have the sole function of preheating the electrodes. Other conventional starter mechanisms are additionally equipped with a circuit-breaking capability; many commercially manufactured starter mechanisms include a built-in circuit-breaker which stops the flow of current in the circuit when it is abnormally stressed.

Circuit-breaking means such as circuit-breakers and fuses are well known in the art, and the appropriate implementation of such a protective device as a current-stopping "safety valve" for a fluorescent lighting application is well within the skill of the ordinarily skilled artisan. "Thermal" circuit-breakers and "thermal" fuses, for example, act responsively to excessive heat generated by high voltages. Accordingly, it is recommended practice for many embodiments and applications that the alarm means according to the present invention be accompanied by circuit-breaking means which may serve as a subsequently actuated back-up in the event that the initially actuated alarm means fails to motivate an individual or personnel to remedial action.

The multi-functional, uni-structural starter mechanism in accordance with the present invention is a unit which has the function of preheating the electrodes and the additional function of alarming responsively to current change associated with the occurrence of fluorescent blinking. Most embodiments of the present invention preferably further include the function of breaking the circuit and thereby ceasing operation of the fluorescent lamp at an appropriate time subsequent to commencement of the alarming.

Structurally unitary embodiments of the present invention conveniently and efficiently integrate the preheating function and the alarming function (and for many preferred embodiments, the circuit-breaking function) into a single structural unit which supplants the conventional starter unit. Installation in a fluorescent lamp of this invention's alarming circuitry as part of such an integrated structural unit should be more efficient and cost-effective than installation thereof as a separate structural unit. Moreover, this integrated structural configuration advantageously facilitates electrical engagement of its starter-related electronics with its alarm-related electronics, not only whereby its alarm means is responsive to current fluctuations of its starter means, but also whereby the powering of its alarm means is supplied through its starter means.

Other objects, advantages and features of this invention will become apparent from the following detailed description of the invention when considered in conjunction with the accompanying drawings.

BRIEF DESCRIPTION OF THE DRAWINGS

In order that the present invention may be clearly understood, it will now be described by way of example, with reference to the accompanying drawings, wherein like numbers indicate the same or similar components, and wherein.

DETAILED DESCRIPTION OF THE INVENTION

Figure 1:
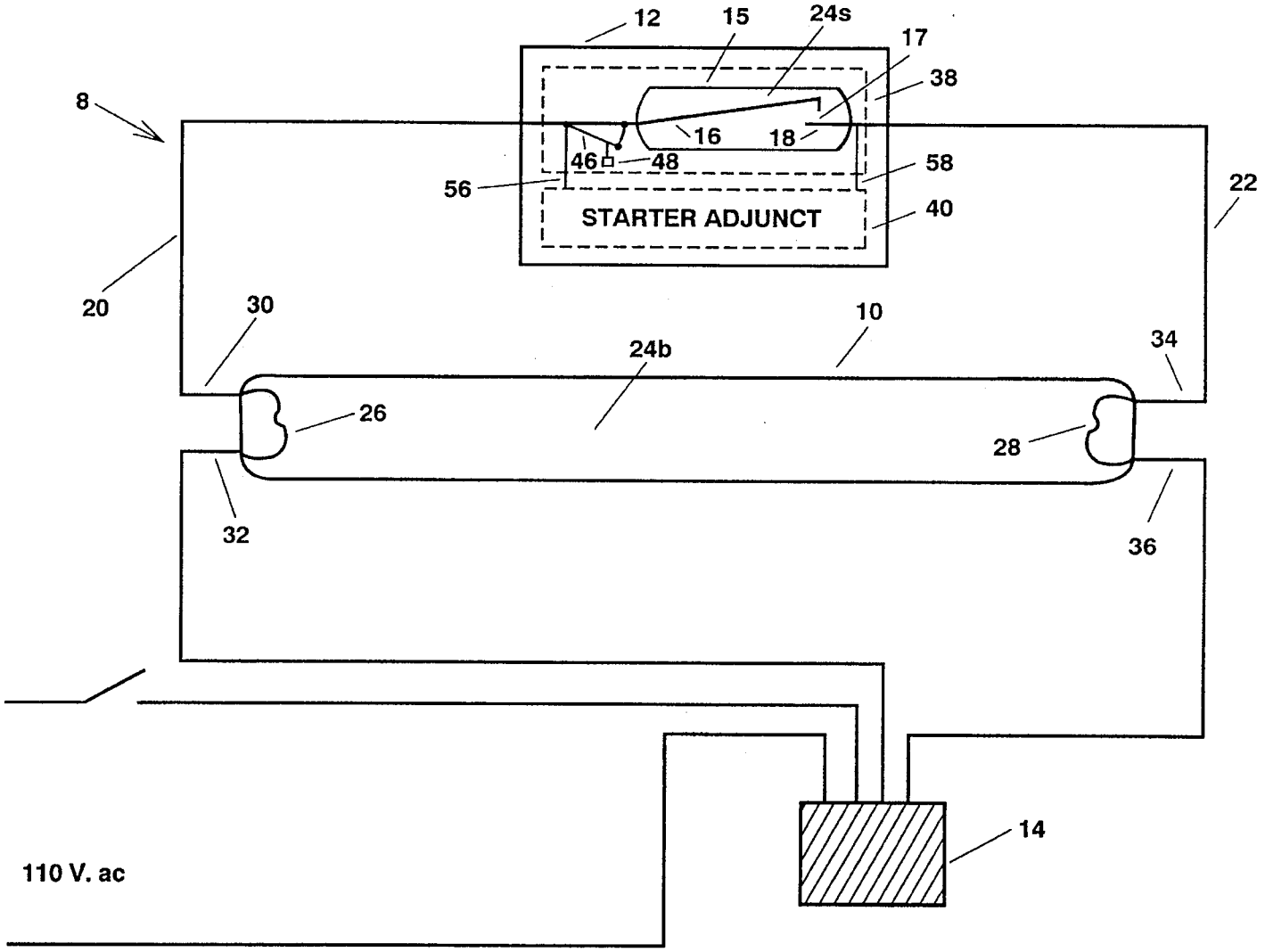
FIG. 1 is a schematic electronic diagram of an embodiment of a fluorescent lamp which includes a multi-functional starter unit in accordance with the present invention.

Referring now to FIG. 1, fluorescent lamp 8 has fluorescent bulb 10, starter unit 12 and ballast 14. Fluorescent bulb 10 is operated on ac in series with starter unit 12 and ballast 14. Starter unit 12 is multi-functional in accordance with the present invention. Multi-functional starter unit 12 has a starter tube 15 which has fill gas 24*s*, left pole 16 (which is made of bimetal) and right pole 18. Left pole 16 is connected to left fluorescent lead 20 and right pole 18 is connected to right fluorescent lead 22. Fluorescent bulb 10 has fill gas 24*b*, left electrode 26, right electrode 28, two left pins 30 and 32 and two right pins 34 and 36.

Upon application of the line voltage a glow discharge through gas 24*s* commences between bimetal left pole 16 and right pole 18 whereby a heating effect causes left pole 16 to bend into contact with right pole 18; starter relay 17 between left pole 16 and right pole 18 is now closed. The ensuing short circuit current through ballast 14 heats up electrodes 26 and 28. This short circuit in multi-functional starter unit 12 causes the glow discharge in starter tube 15 to cease and, consequently, left pole 16 to cool down and break contact with right pole 18; starter relay 17 between left pole 16 and right pole 18 is now open. Due to the sudden interruption of the short circuit current, a voltage surge is produced by ballast 14 and applied over the discharge path through gas 24*b* in bulb 10, causing bulb 10 to ignite.

Voltage across starter relay 17 varies between two voltage levels. When starter relay 17 is closed, the voltage across the relay is or approaches zero. When starter relay 17 is open, the voltage across the relay generally is, depending on the nature of bulb 10 and ballast 14, at least the line voltage (e.g., 110 volts) and can reach or exceed 200 volts.

Figure 3:
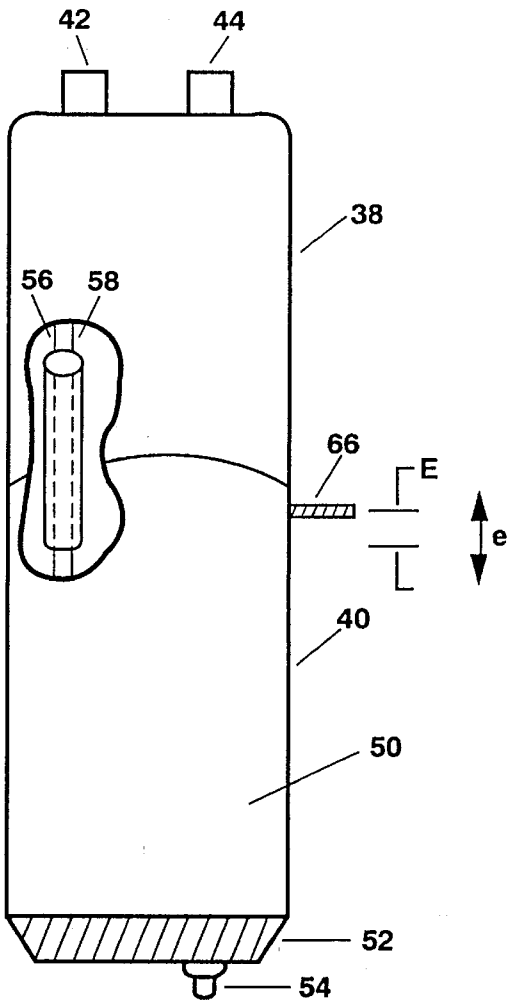
FIG. 3 is a diagrammatic elevated view as in FIG. 2 of another embodiment of the multi-functional starter unit shown FIG. 1.
Figure 2:
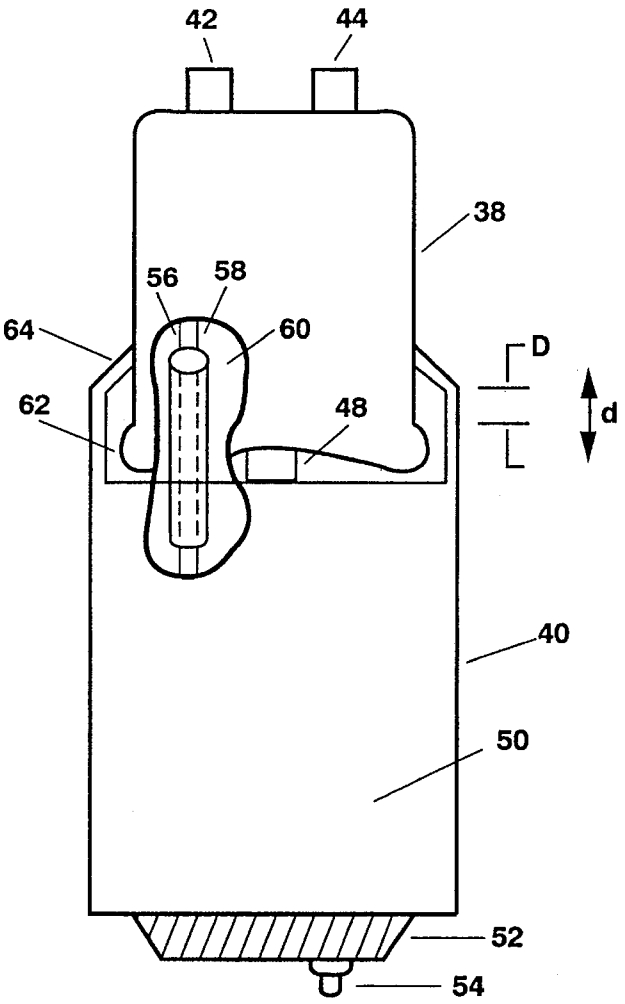
FIG. 2 is a diagrammatic elevated view of an embodiment of the multi-functional starter unit shown FIG. 1, with a portion cut away to show some interior detail.

With particular reference to either FIG. 2 or FIG. 3, and still with reference to FIG. 1, starter unit 12 has commercial starter 38 and starter adjunct 40. Commercial starter 38 is the starter mechanism which was found in conventional preheat-starting fluorescent lamp 8 as originally manufactured and commercially obtained. Adjunct 40 is coupled with commercial starter 38 so as to together provide multi-functional, uni-structural starter unit 12, which has replaced commercial starter 38.

Commercial starter 38, for example standard starter number "FS-40" for 40 watt bulb 10, includes two twist connectors 42 and 44, circuit-breaker 46 and overload switch 48. Left connector 42 is for connecting left pole 16 to left fluorescent lead 20; right connector 44 is for connecting right pole 18 to right fluorescent lead 22. Overload switch 48, which for many such commercial starters 38 includes a red-colored push-button, is activated in order to reset commercial starter 20 once circuit-breaker 46 has been actuated.

Adjunct 40 is an electronics package having case 50 which contains electronic components including high-pitched (e.g., approximately 12 kHz) beeper 52, flashing red light-emitting diode (LED) light 54, left alarm lead 56, right alarm lead 58 and sleeve 60. Left alarm lead 56 is connected to left pole 16; right alarm lead 58 is connected to right pole 18. Left alarm lead 56 and right alarm lead 58 pass through sleeve 60.

Coupling of adjunct 40 with commercial starter 38 is accomplished by any of multifarious means known to the ordinarily skilled artisan. For example, in FIG. 2 case 50 slidably clamps over commercial starter 38. Commercial starter 38 has ridges 62, and case 50 has lips 64, for preventing upcoupling of adjunct 40 and commercial starter 38. Case 50 may be slidably moved a slight distance downward or upward with respect to commercial starter 38, as shown by bidirectional arrow d and distance D. When case 50 is moved sufficiently upward relative to commercial starter 38, overload switch 48 is pushed and thereby activated. In FIG. 3, case 50 is fixedly attached to commercial starter 38; protruding lever 66 mechanically engages overload switch 48 and is pivotable a slight distance downward or upward as shown by bidirectional arrow e and distance E, and thus may be pushed upward to activate overload switch 48.

Figure 4:
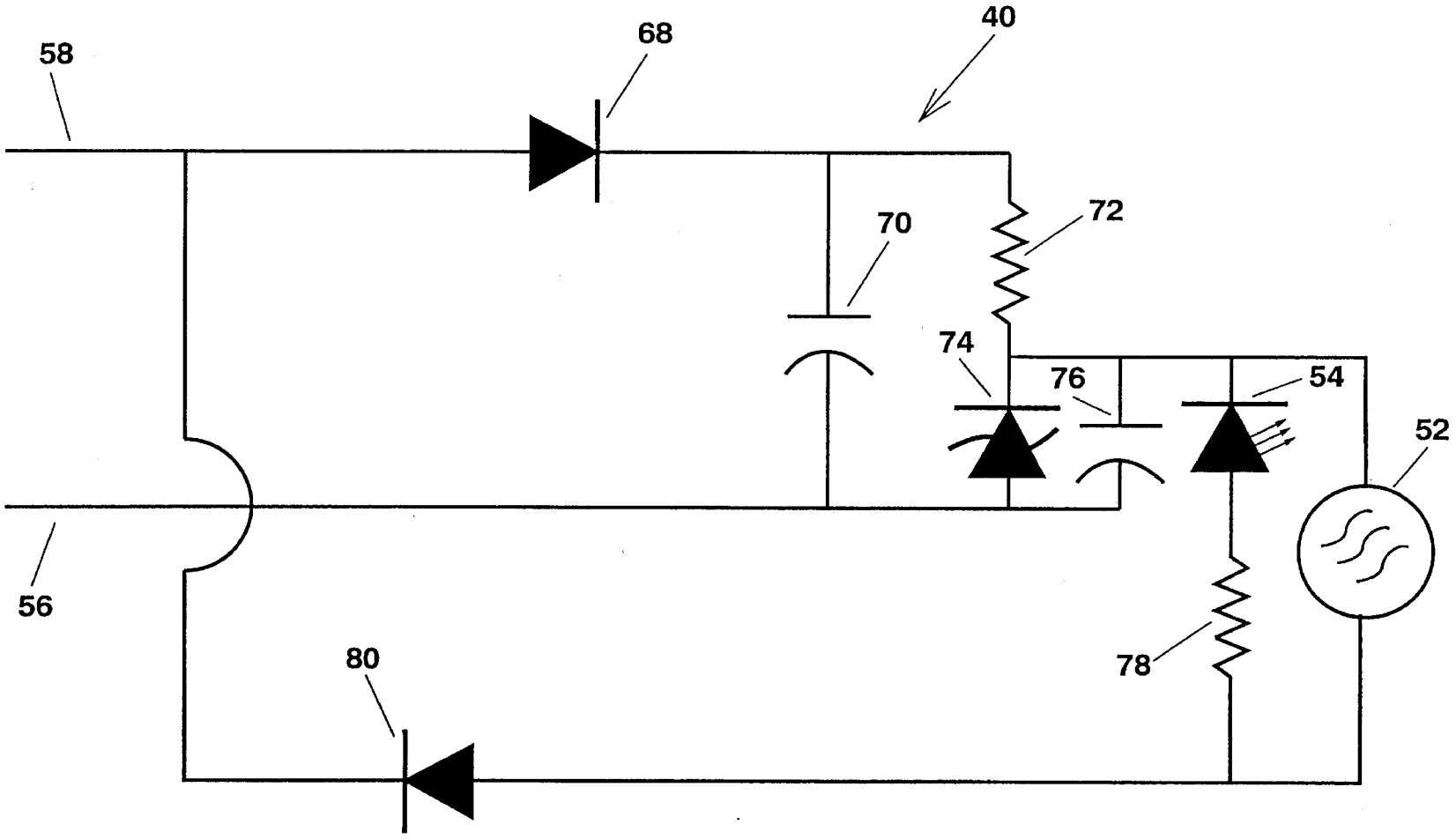
FIG. 4 is a schematic electronic diagram of an embodiment of the alarming circuitry pertaining to the starter adjunct of the multi-functional starter unit shown FIG. 1.

Still referring to FIG. 1, when fluorescent lamp 8 is properly functioning, starter relay 17 remains open while fluorescent bulb 10 is illuminated. Now referring to FIG. 4, g.p. diode 68 (e.g., 600 V.) rectifies approximately 110 V. ac into direct current (dc). Capacitor 70 (e.g., 50 mfd/250 V. dc) filters (smooths) the dc pulses, which then pass through dropping resistor 72 so that zener diode 74 (e.g., 12 V.) rectifies and charges capacitor 76 (e.g., 2,000 mfd/15 V. dc), which holds the 12 V. dc charge as long as fluorescent bulb 10 remains lit. Hence, in the absence of flickering overload, capacitor 76 remains charged with 12 V., and beeper 52 and LED light 54 remain inactivated.

During improper functioning of fluorescent lamp 8 whereby fluorescent bulb 10 is blinking, starter relay 17 opens when fluorescent bulb 10 is lit and closes when fluorescent bulb 10 is unlit. Often the blinking is attributable to a "weakened" condition of fluorescent bulb 10, which fails to maintain illumination. As this "on again, off again" action of the starting load for left pole 16 and right pole 18 persists, the resultant flickering overload escalates and ballast 14 increasingly overworks and overheats.

During blinking, beeper 52 and LED light 54 each actuate intermittently in accordance with the blinking. Beeper 52 sounds and LED light 54 flashes in virtual concurrence with the state of deillumination of fluorescent bulb 10; beeper 52 is silent and LED light 54 is unlit in virtual concurrence with the state of illumination of fluorescent bulb 10.

Resistor 78 is utilized for LED light 54. Upon deillumination of fluorescent bulb 10, there ceases to be a potential difference across starter relay 17, which is closed. There consequently ceases to be a potential difference between beeper 52 and resistor 78 (e.g., 5 kilohm), whereupon g.p.

diode 68 is inactivated, thereby blocking the direct current, and g.p. diode 80 (e.g., 600 V.) is activated, thereby allowing return path of voltage stored in capacitor 76, resulting in actuation of beeper 52 and LED light 54. The direct current charge which has been held by capacitor 76 powers operation of beeper 52 and LED light 54. While fluorescent bulb 10 remains lit, the alarm circuit remains fully charged in anticipation of the eventuality that fluorescent bulb 10 becomes unlit and, concomitantly, beeper 52 and LED light 54 actuate.

When fluorescent bulb 10 reilluminates, the potential difference across starter relay 17, now open, is reestablished; g.p. diode 80 is inactivated, thereby blocking the direct current (and, hence, ceasing return path of voltage stored in capacitor 76), and g.p. diode 68 is activated, thereby allowing rectification of ac into dc, resulting in deactuation of beeper 52 and LED light 54. The circuit through capacitor 70, dropping resistor 72, zener diode 74 and capacitor 76, wherein capacitor 76 holds the direct current charge, is reperpetuated for as long as fluorescent bulb 10 remains lit.

Even when fluorescent lamp 8 is functioning normally, for some embodiments the alarm according to this invention may be momentarily triggered upon "turning on" fluorescent lamp 8. Capacitor 76 may hold some direct current charge while fluorescent lamp 8 is "off;" whether alarm beeping/flashing occurs upon starting fluorescent lamp 8 may relate to the amount of direct current charge which remains held by capacitor 76 while fluorescent lamp 8 is "off," which may depend on the amount of time which has elapsed since fluorescent lamp 8 was last "turned off." Such momentary beeping/flashing upon starting fluorescent lamp 8 should be nonexistent or negligible for most embodiments, and may even be desirable for some applications. If desired, the ordinarily skilled artisan is capable of preventing such start-up alarming, e.g., via blocking circuitry or time-delay circuitry.

Other embodiments of this invention will be apparent to those skilled in the art from a consideration of this specification or practice of the invention disclosed herein. Various omissions, modifications and changes to the principles described may be made by one skilled in the art without departing from the true scope and spirit of the invention which is indicated by the following claims.

What is claimed is:

1. In an illuminative apparatus of the type having a preheat circuit wherein a starter mechanism is employed for initially effecting an attempt to light a fluorescent lamp which is unlit, for subsequently effecting said attempt each time said fluorescent lamp becomes unlit, and for repeatedly effecting said attempt while said fluorescent lamp remains unlit until said fluorescent lamp becomes lit, said starter mechanism having a starter relay between two poles, said fluorescent lamp having a discharge path between two electrodes, said starter relay being open while said fluorescent lamp remains lit, each said attempt to light said fluorescent lamp including the momentary closure of said starter relay so as to preheat said electrodes and the opening of said starter relay so as to cause a voltage surge over said discharge path an improved starter mechanism comprising alarm means responsive to voltage change associated with each said attempt to light said fluorescent lamp, said alarm means including an alarm circuit which is connected to said two poles across said starter relay, said alarm circuit including at least one indicator and a storage element for energizing said at least one indicator, wherein said storage element receives and holds voltage while said fluorescent lamp remains lit, and wherein, each said time said fluorescent lamp become unlit and while said fluorescent lamp remains unlit, said at least one indicator is energized as a result of each said momentary closure set of said starter relay.

2. An improved starter mechanism in claim 1, wherein said at least one indicator includes an auditory indicator.

3. An improved starter mechanism as in claim 1, wherein said at least one indicator includes a visual indicator.

4. An improved starter mechanism in claim 1, wherein said at least one indicator includes an auditory indicator and a visual indicator.

5. An improved starter mechanism as in claim 1, further comprising circuit-breaking means responsive to said voltage change associated with each said attempt to light said fluorescent lamp.

6. An improved starter mechanism as in claim 1, wherein said illuminative apparatus includes circuit-breaking means responsive to said voltage change associated with each said attempt to light said fluorescent lamp.

7. An improved illuminative apparatus, said illuminative apparatus being of the type having a preheat circuit wherein a starter mechanism is employed for initially effecting an attempt to light a fluorescent lamp which is unlit, for subsequently effecting said attempt each time said fluorescent lamp becomes unlit, and for repeatedly effecting said attempt while said fluorescent lamp remains unlit until said fluorescent lamp becomes lit, said starter mechanism having a starter relay between two poles, said fluorescent lamp having a discharge path between two electrodes, said starter relay being open while said fluorescent lamp remains lit, each said attempt to light said fluorescent lamp including the momentary closure of said starter relay so as to preheat said electrodes and the opening of said starter relay so as to cause a voltage surge over said discharge path, wherein the improvement comprises alarm means responsive to voltage change associated with each said attempt to light said fluorescent lamp, said alarm means including an alarm circuit which is connected to said two poles across said starter relay, said alarm circuit including at least one indicator and a storage element for energizing said at least one indicator, wherein said storage element receives and holds voltage while said fluorescent lamp remains lit, and wherein, each said time said fluorescent lamp become unlit and while said fluorescent lamp remains unlit, said at least one indicator is energized as a result of each said momentary closure of said starter relay.

8. An improved illuminative apparatus as in claim 7, wherein said alarm means is structurally coupled with said starter mechanism.

9. An improved illuminative apparatus as in claim 7, wherein said at least one indicator includes an auditory indicator.

10. An improved illuminative apparatus as in claim 7, wherein said at least one indicator includes a visual indicator.

11. An improved illuminative apparatus as in claim 7, wherein said at least one indicator includes an auditory indicator and a visual indicator.

12. An improved illuminative apparatus as in claim 8, wherein said improvement further comprises circuit-breaking means structurally coupled with said starter mechanism and responsive to said voltage change associated with each said attempt to light said fluorescent lamp.

13. An improved illuminative apparatus as in claim 7, wherein said illuminative apparatus includes circuit-breaking means responsive to said voltage change associated with each said attempt to light said fluorescent lamp.

* * * * *